United States Patent [19]

Fleischmann et al.

[11] 4,349,940

[45] Sep. 21, 1982

[54] FAUCET HANDLE ASSEMBLY

[75] Inventors: Gary A. Fleischmann; Clarence E. Klessig, both of Sheboygan, Wis.

[73] Assignee: Kohler Co., Kohler, Wis.

[21] Appl. No.: 228,458

[22] Filed: Jan. 26, 1981

[51] Int. Cl.[3] ..... E05B 7/00

[52] U.S. Cl. ..... 16/110 R; 16/117; D23/21

[58] Field of Search ..... 16/117, 110, 118, 124; D23/28, 29, 30, 31; D8/499; 248/212, 213, 251; 4/192, 252 R; 74/548, 553

[56] References Cited

U.S. PATENT DOCUMENTS

| | | | |
|---|---|---|---|
| D. 263,989 | 4/1982 | Fleischmann et al. | D23/21 |
| 553,699 | 1/1896 | Totham . | |
| 638,611 | 12/1899 | Totham . | |
| 1,110,959 | 9/1914 | Niewiardowski . | |
| 2,402,127 | 6/1946 | Cohn | 211/123 |
| 2,542,941 | 2/1951 | Post | 248/251 |
| 2,590,410 | 3/1952 | Hurley | 248/206 |
| 2,640,671 | 6/1953 | Grady | 248/225 |
| 2,743,461 | 5/1956 | Urbas | 4/191 |
| 3,250,148 | 5/1966 | Soles | 74/548 |
| 3,301,580 | 1/1967 | Greitzer | 287/53 |
| 3,325,132 | 5/1965 | Olson | 248/274 |
| 3,396,604 | 8/1968 | Samuels | 74/548 |
| 3,572,162 | 3/1971 | Gresham | 74/553 |
| 3,655,785 | 5/1972 | Moal | 74/543 |
| 3,864,051 | 2/1975 | Reid | 403/408 |
| 3,991,427 | 11/1976 | Kemker | 4/192 |

OTHER PUBLICATIONS

A Kohler Advertisement entitled "Installation Instructions For Alterna Wood Handles", Feb. 1979.

*Primary Examiner*—Paul A. Bell
*Assistant Examiner*—John S. Brown
*Attorney, Agent, or Firm*—Quarles & Brady

[57] ABSTRACT

A faucet handle assembly includes an open-ended sleeve connectable to a valve stem by a screw inserted and removed through the open end. A handle projects laterally through openings in the sleeve, and a removable thimble covers the open end, the handle passing through openings in the thimble to hold the thimble in place. In the preferred embodiment, the handle and sleeve openings are non-circular and there are spacers and decorative end nuts to hold the handle axially. The invention is also useful for other items such as towel racks and robe hooks.

12 Claims, 5 Drawing Figures

FAUCET HANDLE ASSEMBLY

BACKGROUND OF THE INVENTION

1. Field of the Invention

This invention relates particularly to faucet handle assemblies, and more specifically to a decorative assembly in which a faucet handle is operatively connected to a conventiona valve control stem without requiring the use of an exposed attachment screw. The invention is also useful for securing items having cross members (such as towel racks) to walls without requiring the use of an exposed attachement screw.

2. Description of the Art

In most faucet assemblies, an exposed valve control stem is provided with a fluted attachment head having a threaded screw hole at its outer end. The typical faucet handle has a fluted socket that receives the head, and an attachment screw is inserted through an access hole that opens through the outer end of the handle. A decorative sleeve usually surrounds the exposed portion of the valve stem below the handle, and is held between the handle and a counter top or the like.

Without more in such assemblies, the attachment screw is exposed. For ease of cleaning and appearance, various attempts have been made to hide the access hole and the screw. For example, special snaps or covers have been developed that can be placed over the access hole and removed when appropriate. Side set screws passing through the handle neck instead of the handle top have also been used. However, the use of special snaps or covers detracts from the decorative appearance of the top of the handle, and is expensive. The use of side set screws detracts from the decorative appearance of the neck of the handle and is awkward.

Another area where exposed attachment screws are a problem is in such things as wall mounted bathroom accessories such as towel racks. Examples of attempts to solve the problem are found in U.S. Pat. No. 2,542,941, issued Feb. 20, 1951 to J. A. Post, and U.S. Pat. No. 2,640,671, issued June 2, 1953 to M. J. Grady. However, typical prior wall mounts for accessories of this kind rely on weak connections, are composed of parts which are expensive to produce, and/or do not completely hide the screw attachment.

It can be seen that the need has existed for an inexpensive, easy to manufacture assembly which is usable in connection with many varied ornamental designs, and which is capable of securely connecting a decorative faucet handle or the like to a stem without the need for an exposed attachment screw.

SUMMARY OF THE INVENTION

The invention provides a faucet handle assembly or the like without an exposed attachment screw. In the preferred embodiment, an open ended decorative sleeve is provided with a fluted socket and is attached directly to a conventional valve control stem by a screw inserted through the open end of the sleeve into the stem. The sleeve has aligned, opposite, non-circular cross openings near its open end above the screw. A decorative thimble is brought down over the open end of the sleeve to cover the open end and hide the screw connection, the thimble having openings which are alignable with the sleeve openings. A cross member in the form of a faucet handle extends through the thimble openings and sleeve openings, and acts to hold the thimble in place.

The portions of the cross member engaged within the sleeve openings are also-non-circular, thus preventing the cross member from rotating about its own axis within the sleeve openings. Decorative spacers in the form of cylindrical tubes are placed over the portions of the cross member between the sleeve and the ends of the cross member, and end nuts are connected at the end of the cross member to hold the spacers on the cross member, all to limit unwanted longitudinal movement of the cross member.

The invention is adaptable to other applications such as towel racks by using a base bracket having a post shaped like a conventional valve stem and then attaching a similar sleeve and thimble. The cross member may be, for example, a towel bar or robe hook.

The objects of the invention include:

a. providing a decorative assembly of the above kind in which the cross member may be operatively connected to the stem without requiring the use of an exposed attachment screw;

b. providing an assembly of the above kind which is usable with a conventional valve stem and in which the parts may be readily removed for inspection, cleaning, and repair;

c. providing an assembly of the above kind in which the cross member may be slid through the thimble and sleeve, and fixed therein against longitudinal movement and rotation about its own axis; and d. providing an assembly of the above kind which is usable in connection with many varied ornamental designs, which is inexpensively and easily constructed, has few parts, and is made of structurally secure elements.

These and still other objects and advantages of the invention will be apparent from the description which follows. In the detailed description which follows, the preferred embodiment of the invention will be described in reference to the accompanying drawings. This embodiment does not represent the full scope of the invention, but rather the invention may be employed in other embodiments. Reference is made to the claims herein for interpreting the breadth of the invention.

DESCRIPTION OF THE PREFERRED EMBODIMENTS

Figure 1:
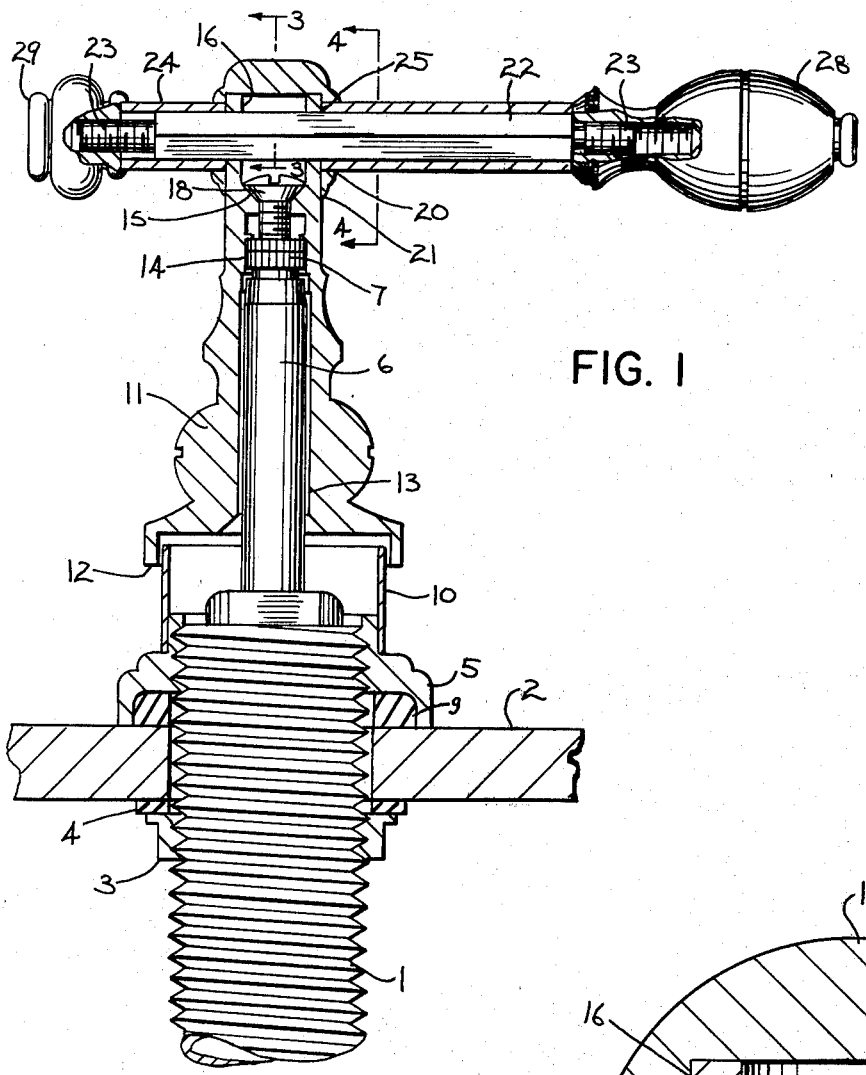
FIG. 1 is a view in cross section, with parts shown broken away, showing a faucet handle assembly constituting a preferred embodiment of the invention, the assembly being shown attached to a valve mounted through a lavatory top.

Referring now to FIG. 1, there is shown the upper threaded portion 1 of a conventional faucet valve housing. The portion 1 projects upwardly through a lavatory top 2, and a threaded attachment nut 3, washer 4, and a threaded decorative escutcheon nut 5 together hold the valve in place relative to the lavatory top 2. A sealing washer 9 can be inserted between the escutcheon nut 5 and lavatory top 2 for sealing the assembly.

A conventional valve control stem 6 protrudes upwardly from the valve housing, and is provided with a fluted attachment head 7, and a threaded attachment screw hole 8 (see FIG. 2) is provided in the top or outer end of the heand 7. The general arrangement of these parts is a common form of construction in the art.

A decorative cylindrical collar 10 is wedged or cemented over the escutcheon nut 5. Although the decorative collar 10 can be eliminated entirely, it has been provided to add an additional accenting feature in the preferred embodiment. An open ended decorative sleeve 11 is placed down over the stem 6. As can be seen from FIG. 1, the sleeve has an enlarged end portion 12 which surrounds the upper end of the collar 10. There is a slight clearance between the bottom of the sleeve 11 and the top of the collar 10, so that the sleeve may rotate over the collar without rubbing aginst it. Running through the interior of the sleeve 11, there is a main interior bore 13 which is of diameter sufficient to receive the valve stem 6 with a relatively loose fit. Near the top of the bore 13, there is a fluted socket 14 that mates with and receives the attachment head 7.

Through cooperation of the socket 14 and head 7, the sleeve 11 and stem 6 rotate as a unit. A narrowing at the top of the socket 14 limits movement of the sleeve 11 downwardly with respect to the stem 6.

Once the sleeve 11 has been placed over the stem 6, and attachment screw or fastener 18 is brought down through an open end 16 of the sleeve 11, against the annular stop ledge 15, and into the threaded screw hole 8 in the top of the the stem. This will securely connect the sleeve 11 to the valve stem 6.

Figure 2:
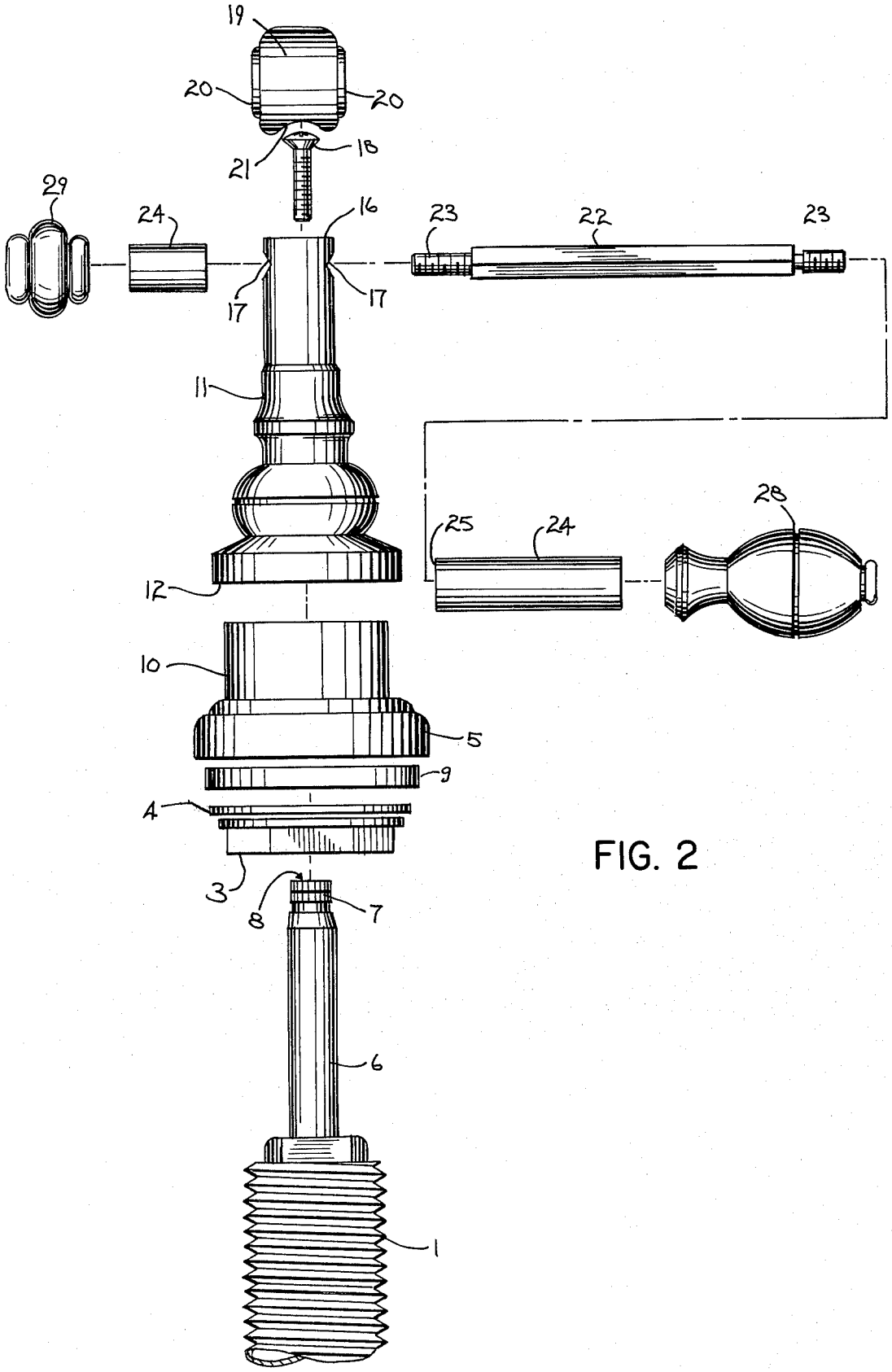
FIG. 2 is an exploded front view in elevation of the parts shown in FIG. 1.

As can be seen in FIG. 2, the sleeve is also provided with two aligned opposite cross openings 17. These openings are formed near the open end 16 of the sleeve. In the preferred embodiment, they are hexagonal.

A thimble 19 is shown having aligned opposite openings 20 and a bottom opening 21. The thimble 19 is slideable over the open end 16 of the sleeve. The thimble openings 20 are circular, and can be aligned with the sleeve openings 17. From FIG. 1, it can be seen that the thimble acts to decoratively hide the screw connection.

There is also shown a cross member 22 having a hexagonal cross section through its middle portion and threaded ends 23, which is slideably engaged in the thimble openings and sleeve openings so as to hold the thimble in place.

Spacers 24 in the form of tubes cover the ends of the cross member 22 which project out from the sleeve. Preferably, the spacers 24 are circular in cross section, whereas the cross member 22 inside the spacers is hexagonal. The ends 25 of the spacers nearest to the sleeve extend into the thimble openings, and are positioned against the sleeve 11, to hide the sleeve openings 17. The ends of the spacers farthest away from the sleeve 11, are positioned against decorative end nuts 28 and 29 when the end nuts are threaded onto the threaded portions 23 of the cross member.

In the preferred embodiment, end nut 28 is the handle grip. To prevent the grip from rotating, the end nut 28 can be made integral with the cross member 22, or attached to the cross member with a locking adhesive.

From this construction, it will be appreciated that rotation of the cross member around the axis of the stem will cause the thimble and sleeve to rotate, thereby carrying the valve stem therewith due to the connection between head 7 and socket 14. This will control the flow of fluids through the valve.

Figure 3:
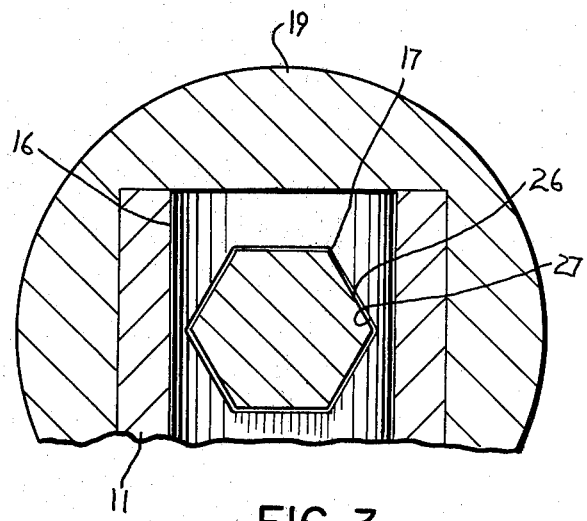
FIG. 3 is a partial enlarged view in cross section taken through the plane 3–3 indicated in FIG. 1.
Figure 4:
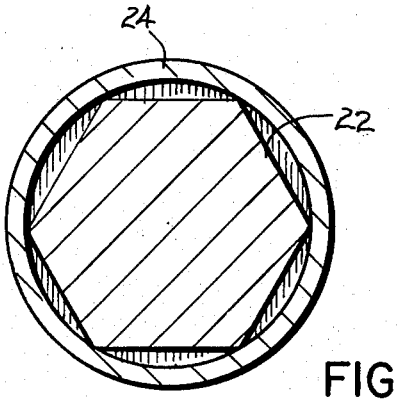
FIG. 4 is a partial enlarged view in cross section taken through the plane 4–4 indicated in FIG. 1.

The cross member 22 is prevented from rotating within the sleeve openings 17 because of the hexagonal shape of portions of the cross member 22 and the sleeve opening 17. This is made clear in FIG. 3 where the abutment surface 26 of the cross member will contact a corresponding surface 27 of the sleeve opening when rotation of the cross member within the sleeve opening is attempted.

It should also be noted that the spacers 24 block movement of either end nut towards the sleeve 11. This effectively prevents the cross member from moving through the openings once the end nuts are attached. By varying the relative length of the spacers, the handle appearance can be changed. For example, the spacers can be made the same length to create a symmetrical appearance.

The invention thus effectively performs its function without the need for an exposed attachment screw. The thimble decoratively and securely covers the screw attachment. The spacers decoratively hide the cross member connection with the sleeve.

Another advantage of the assembly is that it may easily be disassembled. One need only remove end nut 29, slide the cross member 22 out of the sleeve 11, remove the thimble 19, and then unscrew the attachment screw 18.

Figure 5:
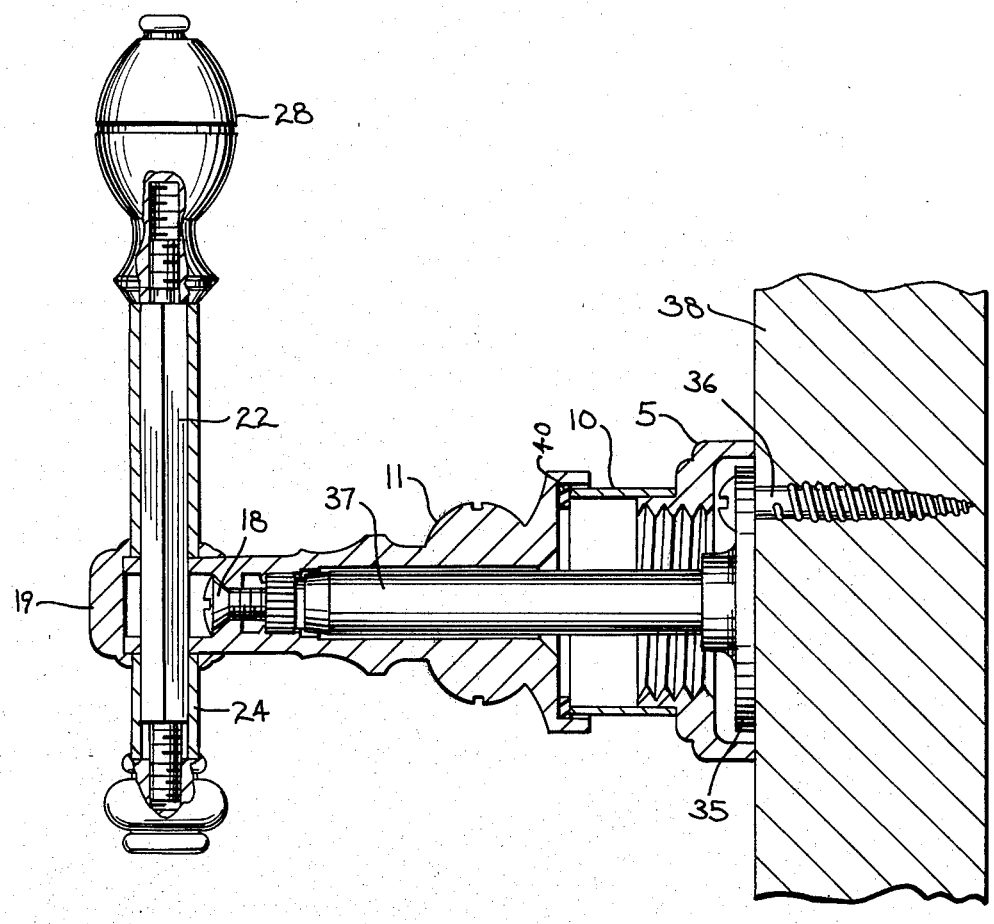
FIG. 5 is a view similar to FIG. 1 but showing a wall mounted robe hook assembly constituting another embodiment of the invention.

Turning now to FIG. 5, it can be seen that the construction described above can be varied slightly to make the invention useful in a wide range of wall mounted bathroom accessories. The robe hook shown in FIG. 5 and other wall mounted bathroom accessories can be formed using a base bracket 35 having a support 37 shaped like the stem 6. The support 37 is rigidly mounted in the base bracket 35 such that the post will not rotate relative to or be removable from the bracket. One method for accomplishing this is by brazing them together. Fastening means in the form of several hidden wall screws 36, one of which is shown, are insertable in alignment slots in the bracket 35 and connect the bracket to the wall 38. The robe hook assembly may be completed using an escutcheon ring 5, a collar 10, a sleeve 11, an attachment screw 18, a cross member 22, end nuts 28, 29, spacers 24, and a thimble 19, such parts being identical to the corresponding parts shown in FIG. 1.

Because of the relatively tight fit between the collar 10 and the sleeve 11, and the relatively tight fit between the collar and the ring 5, the ring will be fixed against movement along the wall 38. However, to improve this fit, an elastomeric washer 40 is inserted between the collar top and sleeve bottom. If the attachment screw 18 is completely screwed into the support 37, this will cause the sleeve 11 to hold the collar 10, ring 5, and if used the elastomeric washer 40 against movement away from the wall 38.

In this configuration, the cross member will not rotate around the longitudinal axis of the sleeve 11. However, such rotation is not a required or even a desirable feature in many items such as a robe hook. It will be apparent from FIG. 5 and the discussion above that a wide range of devices such as towel bars, paper holders, towel rings, toothbrush holders, soap stands and the like can incorporate the concept shown. Further, the screw 18 can be lengthened and attached directly to the wall 38, thereby eliminating the need for the post 37, base bracket 35 and hidden screw 36. The wall will then directly act as the support for the assembly. All of these variations are meant to be within the scope of the invention.

Thus, the invention provides an improved faucet handle assembly or the like. While the preferred embodiments have been described above, it is readily apparent to those skilled in the art that a number of modifications and changes may be made without departing from the spirit and socpe of the invention. For example, while in the preferred embodiment all of the parts of the invention are made of a decorative metal such as brass, many other materials may also be suitable. Other possible modifications would be to make the thimble openings 20 and the spacers 24 hexagonal in cross section to correspond to the shape of the cross member or to make the cross member 22, the thimble openings 20, the cross openings 17 and the spacers 24 all circular. All such and other modifications are meant to be within the scope of the invention.

I claim:

1. A faucet handle assembly or the like connectable to a support comprising:

an open-ended sleeve which is connectable to the support by a fastener inserted and removed through the open end, the sleeve having aligned opposite cross openings near the open end; a cross member engaged within the cross openings; and a thimble that covers the open end and has opposite openings aligned with the cross openings, the cross member also engaged within the thimble openings to hold the thimble in place.

2. A faucet handle assembly or the like as recited in claim 1, wherein the support to which the sleeve is connectable is a stem.

3. A faucet handle assembly or the like as recited in claim 2, wherein:

the cross member projects laterally from the sleeve in at least one direction ; there is an enlarged end nut attached at the outer end of the projecting portion; and there is a spacer positioned on the projecting portion between the end nut and sleeve to limit movement of the end nut towards the sleeve.

4. A faucet handle assembly or the like as recited in claim 3, wherein the spacer extends into a thimble opening.

5. A faucet handle assembly or the like as recited in claim 2, wherein a sleeve cross opening is non-circular; and a portion of the cross member engaged with this non-circular cross opening is also non-circular, whereby the rotation of the cross member about its own axis in the cross opening is limited.

6. A faucet handle assembly or the like connectable to a stem comprising:

an open-ended sleeve which is connectable to the stem by a fastener inserted and removed through the open end, the sleeve having aligned opposite cross openings which are non-circular, the cross openings being formed near the open end of the sleeve;

a cross member slideably engaged within the cross openings and projecting laterally from the sleeve in at least one direction, the cross member having a non-circular portion within the cross openings which mate with the non-circular cross openings;

a thimble that covers the open end and has opposite openings aligned with the cross openings, the cross member also slideably engaged within the thimble openings to hold the thimble in place;

an end nut connected to the end of the projecting portion of the cross member; and a spacer positioned on the projecting portion of the cross member between the end nut and sleeve to limit the movement of the end nut towards the sleeve, the spacer extending into a thimble opening.

7. A faucet handle assembly or the like connectable to a valve control stem comprising:

an open-ended sleeve which is connectable to the stem by a screw inserted in the stem and removed through the open end, the sleeve having aligned opposite cross openings near the open end; a cross member engaged within the cross openings; and a thimble that covers the open end and has opposite openings aligned with the cross openings, the cross member also engaged within the thimble openings to hold the thimble in place.

8. A faucet handle assembly or the like as recited in claim 7, wherein the valve control stem is formed with a fluted head and the open ended sleeve is formed with a fluted socket.

9. A faucet handle assembly or the like as recited in claim 8, wherein the fluted head and fluted socket mate, whereby the sleeve and stem rotate as a unit.

10. A faucet handle assembly or the like as recited in claim 9, wherein:

the cross member projects laterally from the sleeve in at least one direction; there is an enlarged end nut attached at the outer end of the projecting portion; and there is a spacer positioned on the projecting portion between the end nut and sleeve to limit movement of the end nut towards the sleeve.

11. A faucet handle assembly or the like as recited in claim 10, wherein the spacer extends into a thimble opening.

12. A faucet handle assembly or the like as recited in claim 7, wherein a sleeve cross opening is non-circular; and a portion of the cross member engaged with this cross opening is also non-circular, whereby the rotation of the cross member about its own axis in the cross openings is limited.

* * * * *